United States Patent [19]

Solov et al.

[11] 3,974,351

[45] Aug. 10, 1976

[54] WRIST WATCH PUSH-BUTTON DEVICE

[76] Inventors: Irving Solov, 61-04 - 218th St., Bayside, Long Island City, N.Y. 11364; Hyman Dinstman, 115 Central Park West, New York, N.Y. 10023

[22] Filed: May 16, 1975

[21] Appl. No.: 578,198

[52] U.S. Cl. ..... 200/159 R; 58/23 R; 58/33; 58/34; 58/85.5; 200/340; 200/DIG. 25; 340/365 R

[51] Int. Cl.[2] ..... H01H 3/12; G04C 3/00

[58] Field of Search ..... 58/34, 35 R, 36, 40, 58/41 R, 63, 64, 73, 80, 81, 85.5, 90 B, 23 R, 33; 200/159 R, 340, 245–247, 265, 266, DIG. 25; 340/365 R

[56] References Cited

UNITED STATES PATENTS

| | | | |
|---|---|---|---|
| 3,783,607 | 1/1974 | Feurer | 58/90 B |
| 3,838,568 | 10/1974 | Zurcher et al. | 58/23 R X |
| 3,866,409 | 2/1975 | Tanaka | 58/90 B |

*Primary Examiner*—Stanley J. Witkowski

[57] ABSTRACT

In a preferred embodiment, there is provided a wrist watch casing having push-button mounting apertures and conduits thereof extending laterally through the casing structure from the interior space to exterior space, and within the conduits each respectively is a shaft having an outwardly directed end of uniform cross-section extending along the longitudinal axis of that end of the shaft, with the distal outer terminal end of the shaft being clipped-off at a predetermined point and mounted on the remaining outer end of the shaft there being a button having a receptacle fixedly mounted. The button circumscribingly of a longitudinal axis of the shaft, defines a circumference slightly smaller than inside diameter of an outer end of the conduit such that the button has a base thereof mounted within the space having that inside diameter and is movable when pressed into space at the outer end of the conduit, there being a spring mounted to return the button and shaft to an outwardly biased state, and a retainer structure located at an inner distal end of the shaft retaining the shaft against unlimited movement outwardly in a direction along the shafts longitudinal axis. Intermediate of the axis is an O-ring seal movable with the shaft along the shaft's longitudinal axis within the space of the conduit.

6 Claims, 12 Drawing Figures

WRIST WATCH PUSH-BUTTON DEVICE

This invention relates to wrist watch solid state watches which utilize push-buttons to actuate levers respectively.

BACKGROUND TO THE INVENTION

The present inventor, experienced in the design and manufacture and mechanism of wrist watches, particularly of a solid state type, is aware of expensive inventory necessary to be carried with regard to the push-button mechanism thereof in order to have necessary sizes for all of varying different wrist watches which often differ in the distance between the watch interior space in which the modular works is mounted, and the outer surface of the watch casing. There are major differences in the length of a conduit of one watch as compared to the length of the conduit of another watch, in which conduits push-button mechanisms are mountable prior to insertion of the works or modular works are mountable. Heretofore, it has been the universal practice to prefabricate or manufacture the push-button mechanism in advance in its entirety, and accordingly there have been designed for different watch casings push-button mechanisms having different lengths of shafts, as well as the button non-shifting mechanism having to be elaborate at times in order to have a workable and durable mechanism.

SUMMARY OF THE INVENTION

Objects of the present invention include the overcoming of one or more problems of the type discussed above, together with other novel advantages.

Another object is to obtain a combination of elements as a push-button mechanism adaptable interchangeable in use for solid state watch casings of different dimensions.

Another object is to obtain, together with prior objects, improved mounting mechanisms for the mounting of push-button mechanisms within watch case structures.

Another object is to obtain a novel spring mechanism for biasing outwardly to a non-activated state a push-button within a wrist watch casing.

Another object is to obtain a novel push-button spring mechanism which functions concurrently as a button-retaining structure within the wrist watch casing.

Another object is to obtain a novel push-button spring mechanism which functions concurrently as an alignment structure for holding modular watch works in proper alignment against shifting.

Another object is to obtain an insertable unit as a push-button package, together with one or more of preceding objects.

Another object, in particular, is to obtain a push-button combination for solid state watch casings, in which the shaft length is variably alterable during assemblage thereof.

Other objects become apparent from the preceding and following disclosure.

One or more objects are obtained by the invention as disclosed herein.

Broadly the invention may be defined as a support which may be the watch casing or may be an insert of stepped shape, mountable within a watch casing laterally within the watch casing itself, and mounted within the channel-conduit of the support there being an elongated shaft retained against unlimited outer movement within the channel-conduit, with a spring element biasing the shaft into an outwardly biased position at which the watch modular works would at that state be in an inactivated state, and a push-button defining a receptacle structure for fixedly receiving the outer distal end of the shaft which is composed of material having physical properties such that the outer distal end may have any of predetermined amounts thereof clipped-off or cut-off or snapped-off, or the like, these terms being interchangeable for purposes of this invention, whereby for any particular wrist watch casing the shaft length may be easily adjusted by shortening the shaft before mounting the push-button onto the distal terminal end. Preferably the outer portion of the channel-conduit is of a sufficiently large inner diameter and the shaft sufficiently short, and the outer diameter of the push-button sufficiently small in dimensions, that the base of the button is received in the mounted state within the outer portion of the channel-conduit thereby preventing any tendency for the button to shift laterally or to be wobbly within the channel-conduit, the base or bottom portion of the button or receptacle structure thereof fitting substantially snugly — i.e. with close dimensions — but without binding surfaces, the button thereby being freely movable inwardly when pushed, further into the outer portion of the channel-conduit as the shaft is thereby moved in a direction along its longitudinal elongated axis. The inner terminal end of the shaft defines a typically flat abutting abutment surface facing inwardly typically for engagement with and movement of a switch lever of a modular works of a solid state watch when the push-button is pressed inwardly in said direction along the longitudinal axis of the shaft. Also, preferably, there is defined at the inner terminal end at least two substantially parallel surfaces preferably, the surfaces being on opposite sides of the shaft with both surfaces extending substantially along the longitudinal axis of the shaft, thereby providing a gripping structure for a wrench, this gripping structure or wrench structure, serving to facilitate the holding of the inner terminal end during the mounting of the shaft into the channel-conduit and the mounting of the button onto the outer terminal end of the shaft.

The shaft preferably defines therearound a recessed groove in the nature of a seat into which is mounted an O-ring seal for sealing against fluid and/or moisture entry through the channel-conduit from exterior space to interior space, the O-ring seal being movable with and mounted around the shaft and seated sealably within the seat.

In one preferred embodiment, the retainer structure retaining the shaft against movement in a direction along its longitudinal axis outwardly beyond a predetermined point, is integral with and an enlargement of an inner distal end of the shaft itself. In other embodiments, the retainer structure preferably is in the form of a U-shaped clamp slidable and lockable within a grooved seat defined at an inner distal end portion of the shaft. In one preferred embodiment, the retainer structure having a U-slot extending inwardly from one edge of the retainer structure, is a leaf spring serving a multiple purpose as a spring and as a retainer ring. In a still further preferred embodiment thereof, the leaf spring serves a multiple function as an alignment lock for first aligning by and subsequently retaining the proper alignment of the modular work unit inserted within the central space, the leaf spring having an inwardly-directed flange or other inwardly directed structure shaped and positioned for seating within an indentation of the modular work unit to thereby prevent the mounting of the modular work unit incorrectly as well as primarily for preventing the modular work unit from shifting around to incorrectly aligned positions within the casing inner space, it being apparent that the modular work unit must be at all times properly aligned for activation of any one or more levers thereof by the pressing of the one or more push-buttons.

The invention may be better understood by making reference to the following Figures.

THE FIGURES

FIG. 1 illustrates in side cross-section in-part view, a watch casing structure having a channel-conduit defined therethrough with the shaft mounted therein with a retainer structure locked thereon at an inner end, and the push-button mounted on the outer distal end portion of the shaft and seated partially within the outer portion of the channel-conduit, spring biased into a non-activating state, activatable switch lever structure being diagrammatically illustrated in part in phantom.

Figure 1:
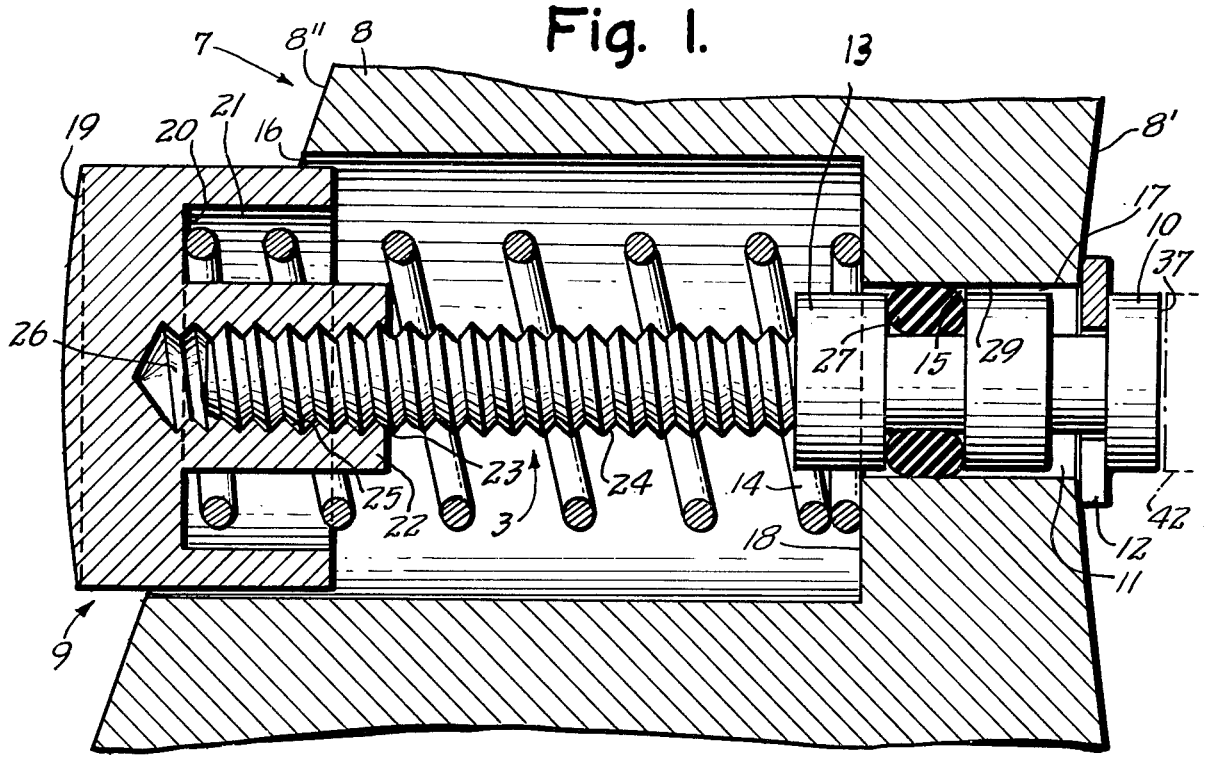
FIG. 1A illustrates a side cross-sectional in-part view the same as FIG. 1, typically, except that the surface design of the male and female structures respectively represent a different embodiment. In like manner, the shaft and receptacle structures of the FIG. 1B represent a still other alternate embodiment.
FIG. 1C illustrates a side cross-sectional view the same as FIG. 1, typically, except that the inner terminal end of the shaft illustrates a preferred embodiment in which the inner terminal end is shaped to receive a wrench, the same being shown in an elevation in-part view in FIG. 2 as taken along lines 2—2 of FIG. 1C.
Figure 3A:
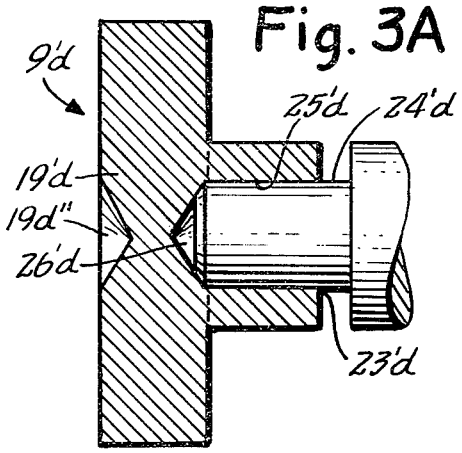
Figure 3B:
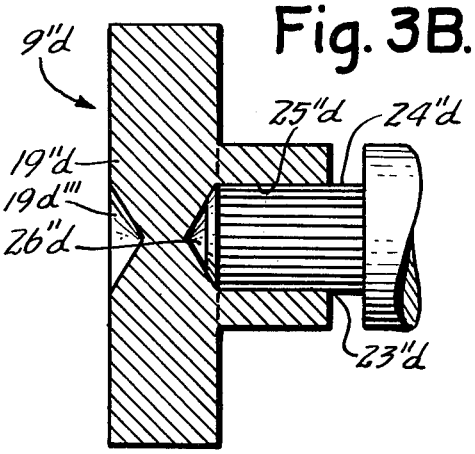
Figure 3:
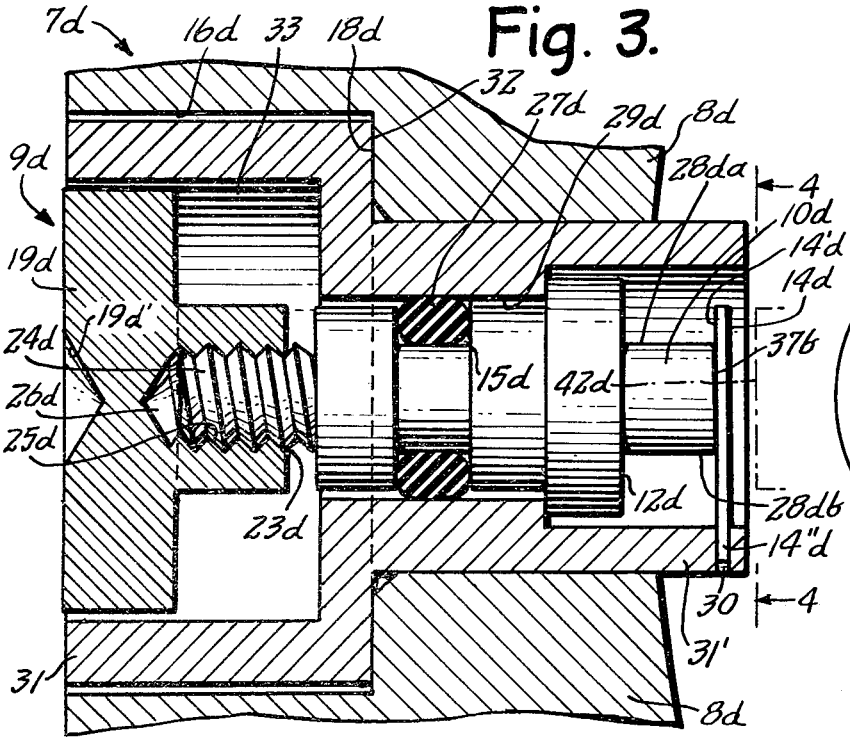

FIG. 3 illustrates a view in side cross-section comparable to the view of FIG. 1, in an in-part view of the casing structure, illustrating an alternate embodiment to that of Figures previously illustrated, this embodiment having a leaf spring biasing against the inner face of the inner terminal end of the shaft as well as this embodiment illustrating the retainer structure as integral and a part of the shaft structure.

Figure 2:
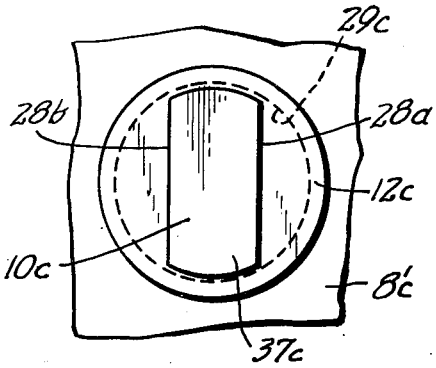
Figure 4:
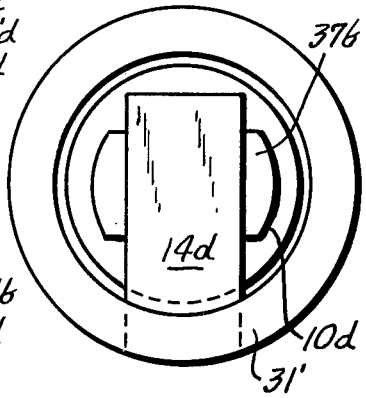

FIG. 3A illustrates another embodiment, and FIG. 3B still another embodiment, as compared to that of FIG. 3, in side cross-section in-part views, differing in the surface structures of the shaft and the receptacle structure; as illustrated in FIG. 4 in elevation view taken along lines 4—4 of FIG. 3, the FIG. 3 embodiment also has the wrench-receivable structure as illustrated for the embodiment of 1C illustrated in FIG. 2.

Figure 7:
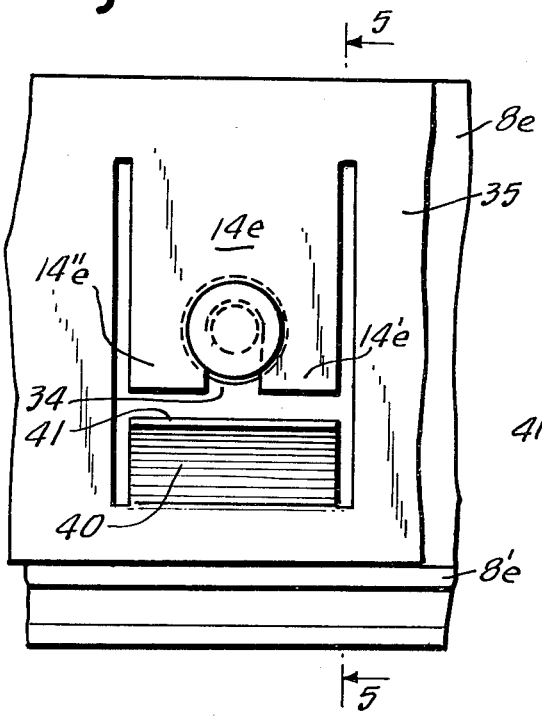
Figure 5:
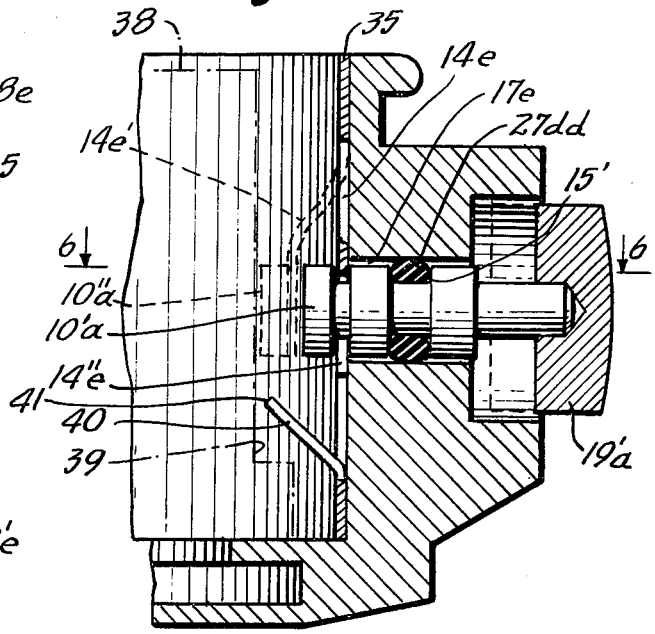
Figure 6:
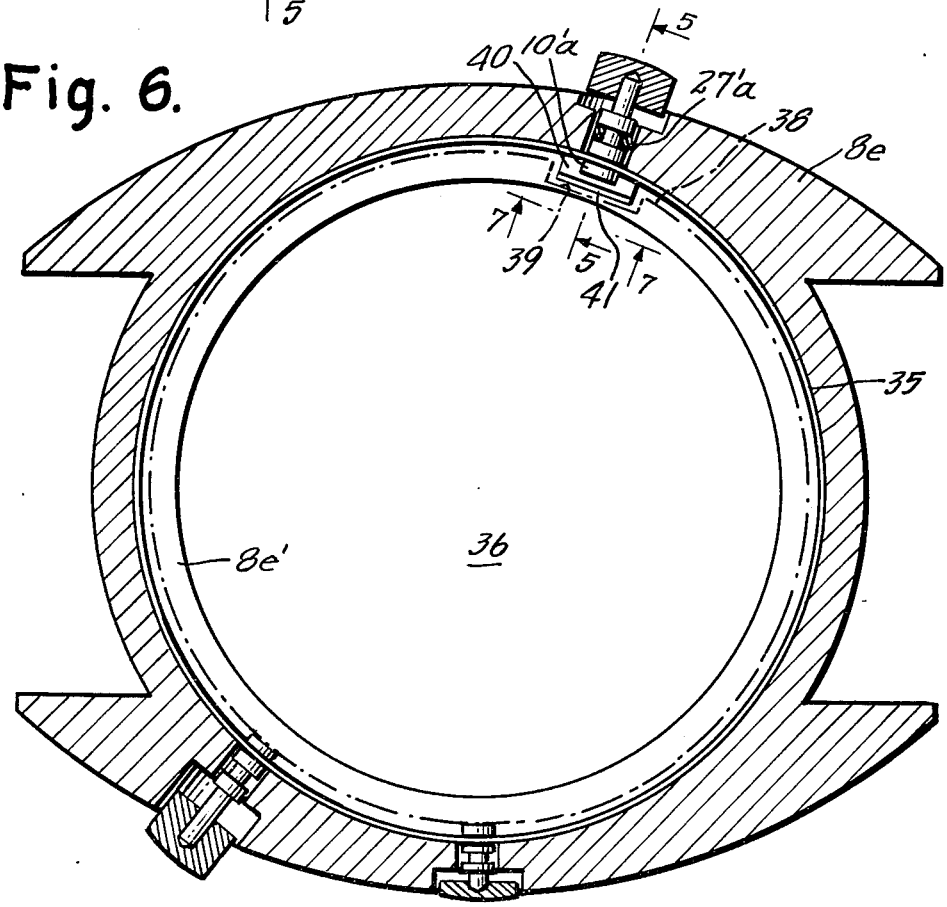

FIGS. 5, 6, and 7 illustrate a common preferred embodiment, illustrating in FIG. 5 an in-part view of a watch casing of a wrist watch in side cross-sectional view, illustrating mounted within the channel-conduit a unit substantially the same as that of FIG. 1 except differing in utilizing a leaf spring functioning as with the FIG. 3 embodiment, this embodiment of FIGS. 5–7 utilizing a leaf spring of ring-configuration as shown best in FIG. 6 in a cross-sectional view taken along lines 6—6 of FIG. 5 and this leaf spring having an inwardly directed cut-out flap seated within a recess of a diagrammatically represented (in phantom) solid state module seen in FIGS. 5, 6, and 7, the cut-out aligning flap structure being best viewable in the elevation side view in FIG. 7 as taken along lines 7—7 of FIG. 6.

DETAILED DESCRIPTION

Figure 1A:
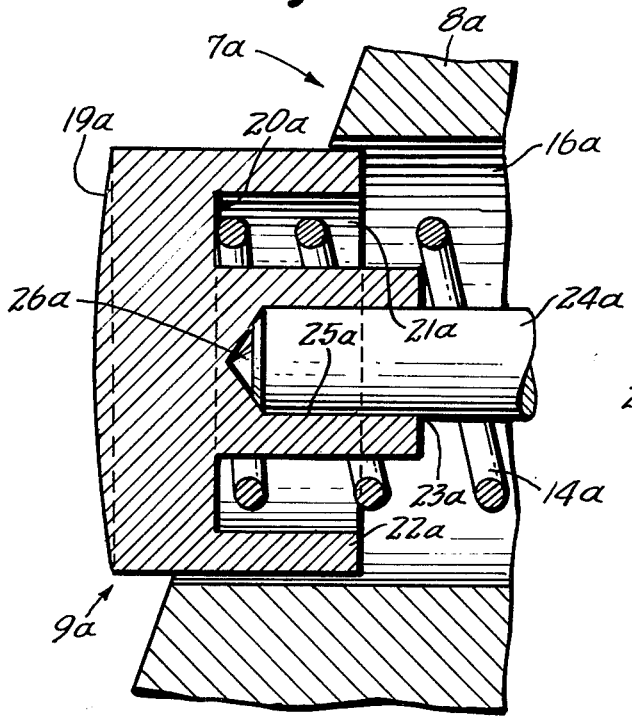
Figure 1B:
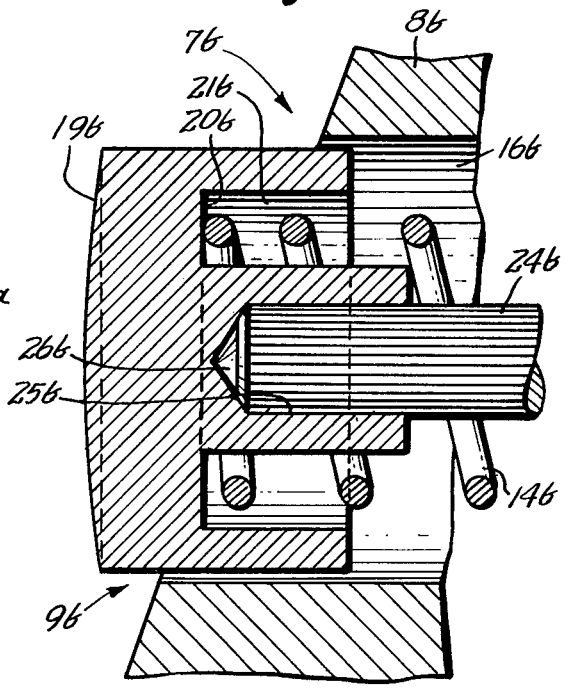
Figure 1C:
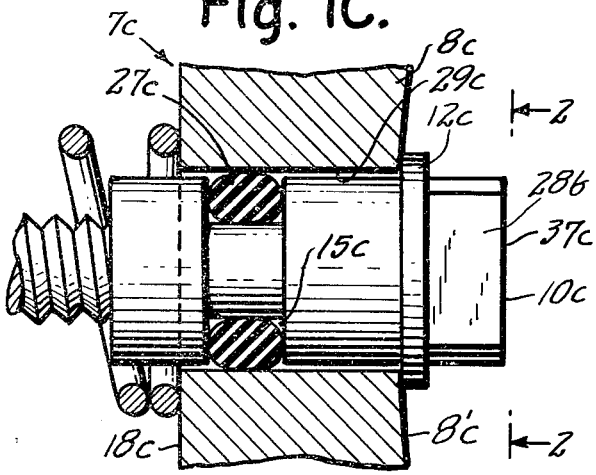

In greater detail, FIG. 1 illustrates a watch casing and push-button combination 7, and FIG. 1A a combination *7a*, and FIG. 1B a combination *7b*, and FIG. 1C a combination *7c*. Accordingly, for substantially analagous parts illustrated in the different embodiments, the identifying element numerals have common base numbers, and do not require repeating in this disclosure for the various illustrating Figures.

For the respective embodiments, there is the typically wrist watch structure 8, *8a*, *8b*, etc., having as illustrated in FIG. 1 the push-button combination 9 mounted within the channel-conduit composed of outer conduit space 17 and outer conduit space 16, the conduit space 16 being herein illustrated as a larger space than 17 in transverse inner diameter transverse to the elongated longitudinal axis of the shaft 10. The shaft 10 has a grooved recess or indentation 11 thereabout with the retainer structure 12 mounted therein around the shaft 10, the retainer structure 12 being typically a U-shaped element snapped within the recess or indentation 11 around the shaft 10, to thereby retain the shaft 10 against being biased further outwardly by spring 14 mounted around an outer distal end portion 13 of the shaft 10, biased between wall face 18 and push-button inner wall face 20 within indentation space 21 of the push-button. It should be noted that a primary inventive concept of this invention is the uniform cross-section of the outer distal end portion 13 such that irrespective of where it is terminated therealong — by cutting, breaking, or the like, the distal outer terminal end always continues to be mateable and seatable with the female receptacle structure of the push-button, as illustrated mated within hole 23 of receptacle structure 22 by male threads 24 mating with female threads 25. Also, the receptacle structure 22 is sufficiently elongated in its space within hole 23 as to provide further adjustment of the exact positioning of the push-button 19 by mere screwing further on or off of the male threads 24. The channel-conduit is typically defined by inner passage walls 29. The shaft 10 has an indentation or groove defined therearound having seated therein at the location illustrated, seal 27 within groove space 15. Inner and outer faces of the support casing structure are illustrated by inner surface 8′ and outer surface 8″. The inner facing inner terminal end surface 37 is engageable with a watch modular lever structure 42 shown diagrammatically in phantom, whenever the push-button 19 is pressed inwardly (downwardly into space 16). The embodiment of FIG. 1A differs only in being a smooth surface *24a* and similarly the inner receiving surface *25a* being a smooth female receiving surface, there being a mating by friction fit only, together with possibly adhesive or cement if desired, or solder, or the like. In like manner, the embodiment of FIG. 1B differs only from the FIGS. 1 and 1A in that the surface *24b* is a knurled surface for improved friction fit and ease of mounting, together with either smooth or knurled surface *25b* as might be desired, preferably smooth.

For all embodiments, consistent with the inventive concept of adjustable length of the shaft portion 13, the composition of at least this portion, and typically of the entire shaft 10, is of a material suitably shearable with ease, such as soft metal, preferably electrically-conductive plastic as metal-impregnated polypropylene, fiberglass, preferably electrically-conductive metals such as brass, nickel silver alloy, stainless steel or the like. Although not preferred, such hard steel could be utilized if desired and be cut by emery wheels. Other conventional and well known materials might also be utilized within the scope of the invention, as long as the physical properties are such that the material does not shatter or split or the like, and as long as there is sufficient firmness or stiffness thereof in the desired shape as to be operative and not too readily flex; however, flexible materials may be utilized as long as the material is sufficiently firm as to transmit force to the modular lever to be actuated when the button is pressed.

The FIG. 1C differs only from the FIGS. 1, 1A and 1B concepts in that this FIG. 1C embodiment includes an enlarged flange structure 12*c* as the retainer structure and has also the oppositely located shaft 10 flat faces 28*a* and 28*b* thereby defining a wrench-receiving structure at the inner terminal end of the shaft 10, as best seen in FIG. 2.

The embodiments of FIGS. 3, 3A, and 3B differ in the outer button surface recesses 19*d*′,19*d*″,and 19*d*‴ respectively, which recess serves as an instrument centering aid during the mounting of the push-buttons 19*d*, 19′*d*, and 19″*d* respectively, and additionally differing in a primary respect by the leaf springs 14*d*, for the FIG. 3 illustration, which presses against and thus maintains in an outwardly biased or positioned state the inner shaft face 10*d* best seen in FIG. 4, and the shaft 10*d* thereby being returnable to the outwardly biased position by the spring 14*d* mounted on the insert support structure 31′ which is of a stepped shape and fixedly friction-seated within the passage space of casing structure 8*d*, with stepped face 32 seated against casing surface 18*d*, this support structure 31′ thus providing for an assembly unit which may be more easily handled outside of the casing 18*d* during the mounting of the push-button assembly 9*d*, and thereafter being placeable seatably and fixedly in unification with the casing structure 8*d*. The integral flange retainer structure 12*d* is analagous to that of retainer structure 12*c* of FIG. 1C. Leaf spring 14*d* is mounted within space 30 of support structure 31′.

FIGS. 5, 6 and 7 illustrate as a common embodiment, different views thereof, wrist watch casing structure 8*e*′ substantially the same in structure of the push-button assembly thereof except for use of a leaf type spring, as that of FIG. 1. In this embodiment, the inventive concepts of the leaf spring are the self-supporting nature of the annularly shaped spring structure as best seen in FIG. 6, having the leaf-spring portion 14*e* thereof cut-out in tab manner with an edge slot as for a conventional retainer structure such as that of FIG. 1 retainer structure 12, and additionally having an additionally cut-out structure or tab 40 bent radially inwardly and seatable as illustrated in the phantom-illusrated module indentation seat 39 viewable in each of FIGS. 5 and 6, the cut-away end 41 being viewable in FIG. 7 illustration because of the inwardly bent position of the tab 40, which being in engagement with the module structure 36 within the indentation seat 39 thereby prevents the module structure 36 from twisting into a position such that if twisted the button face 10′*a* would not be aligned with a switch of module structure 36, and if not aligned, the solid state watch would become non-functional.

It is within the scope of the present invention to make such variations and modifications as would be within ordinary skill of a person of ordinary skill in this art.

We claim:

1. Push-button device comprising in combination: a first support structure defining a through-aperture, the first support structure having inner and outer faces, and said through-aperture including a channel-conduit defined extending between and opening through said inner and outer faces; shaft means for providing an axially movable lever for mounting within said channel-conduit, said shaft means including an elongated shaft extending through an inner port through said inner face from within said channel-conduit and being retained against movement in a predetermined axial direction of its longitudinal axis of said elongated shaft, said shaft being of substantially constant cross-sectional area along a longitudinal axis thereof at an outer distal end portion thereof within said channel-conduit in juxtaposition to an outer port in said outer face, said outer distal end portion being composed of a shearable composition characterized by physical properties such that said shaft may be cut-off at any of desired predetermined points along said outer distal end portion prior to mounting a button head thereon; push-button head means for providing a button head thereon; push-button head means for providing a button head to be pushed to move said shaft in an inward direction along said longitudinal axis, said push-button means defining a receptacle structure defining a receptacle space mountably receivable of a terminal distal end of said outer distal end portion; and spring means for biasing said shaft in an outer direction into said retained being, such that upon pressing inwardly upon said push-button means and thereafter releasing, said shaft and said push-button head means each respectively return to positions held prior to pressing inwardly upon the push-button means.

2. A push-button device of claim 1, in which an inner terminal end of said shaft defines an abutment surface facing substantially inwardly adapted for abutting and pressing inwardly a lever structure when the shaft is caused to move inwardly along said longitudinal axis; and in which said inner terminal end defines on substantially opposite lateral faces of the shaft substantially flat faces extending along said longitudinal axis adapted for engagement by a wrench such that a wrench may be utilized to facilitate joining of the push-button means onto said outer distal end portion.

3. A push-button device of claim 1, in which an inner terminal end of said shaft defines an abutment surface facing substantially inwardly adapted for abutting and pressing inwardly a lever structure when the shaft is caused to move inwardly along said longitudinal axis, in which said shaft means includes an enlarged portion extending transversly to said longitudinal axis, and said enlarged portion is located substantially at said inner terminal end as an integral part of said shaft, said enlarged portion being of sufficiently large outer dimensions such that the enlarged portion is too large to pass through said channel-conduit thereby serving as a retainer structure biased by said spring means into a shaft-retaining position against said inner face of said first support structure.

4. A push-button device of claim 1, in which said spring means includes a spring element mounted in a spring-tensioned state biased between said shaft and said first support structure positioned such that said shaft is biased in a direction along said longitudinal axis toward said outer face, and in which said spring element engages said shaft at an inner distal end thereof and retains thereby said shaft against unlimited movement of the shaft in an outward direction along said longitudinal axis such that said spring element functions as a retainer structure.

5. A push-button device of claim 4, in which said spring element includes an inwardly projected aligning structure shaped to fit into a recess of a module structure and thereby adapted for aligning and maintaining alignment of a module structure relative to said inner distal end of the shaft.

6. A push-button device of claim 1, in which said spring means includes a spring element mounted in a spring-tensioned state biased between said shaft and said first support structure positioned such that said shaft is biased in a direction along said longitudinal axis toward said outer face, and in which said spring element engages said shaft at an inner distal end thereof and retains thereby said shaft against unlimited movement of the shaft in an outward direction along said longitudinal axis such that said spring element functions as a retainer structure, said spring element including an inwardly projected aligning structure shaped to fit into a recess of a module structure and thereby adapted for aligning and maintaining alignment of a module structure relative to said inner distal end of the shaft.

* * * * *